US008660471B2

(12) United States Patent
Takahashi et al.

(10) Patent No.: US 8,660,471 B2
(45) Date of Patent: Feb. 25, 2014

(54) DEVELOPER SUPPLY DEVICE AND IMAGE FORMING APPARATUS HAVING THE SAME

(75) Inventors: Keisuke Takahashi, Aichi (JP); Takanori Uno, Aichi (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 387 days.

(21) Appl. No.: 13/073,178

(22) Filed: Mar. 28, 2011

(65) Prior Publication Data

US 2011/0293335 A1 Dec. 1, 2011

(30) Foreign Application Priority Data

May 31, 2010 (JP) ..... 2010-124070

(51) Int. Cl.
*G03G 15/08* (2006.01)

(52) U.S. Cl.
USPC ..... 399/281; 399/55; 399/266; 399/283; 399/285; 399/289; 399/290; 399/291

(58) Field of Classification Search
USPC ..... 399/55, 266, 281, 283, 285, 289, 290, 399/291
See application file for complete search history.

(56) References Cited

U.S. PATENT DOCUMENTS 5,142,336 A 8/1992 Hotomi et al.
2004/0223792 A1 11/2004 Aoki et al.
2009/0175662 A1 7/2009 Nishiwaki
2009/0238611 A1 9/2009 Hazeyama
2010/0015546 A1* 1/2010 Oki et al. ..... 430/112

FOREIGN PATENT DOCUMENTS

| | | |
|---|---|---|
| JP | HEI 3-12678 | 1/1991 |
| JP | 2004-279880 | 10/2004 |
| JP | 2004-280068 | 10/2004 |
| JP | 2008-70803 | 3/2008 |
| JP | 2009-229674 | 10/2009 |

* cited by examiner

*Primary Examiner* — Ryan Walsh

(74) *Attorney, Agent, or Firm* — Scully, Scott, Murphy & Presser, PC

(57) ABSTRACT

A developer supply device is provided, which includes a developer retrieving member disposed to face a developer holding surface of a developer holding member across a predetermined distance in a position downstream relative to a developer supply position where the developer holding member faces an intended device to be supplied with development agent in a direction perpendicular to a main scanning direction parallel to an axial direction of the developer holding member. The developer retrieving member is driven to rotate around an axis parallel to the main scanning direction and configured to retrieve the development agent from the developer holding surface under a retrieving electric field that is generated when a retrieving voltage is applied between the developer retrieving member and the developer holding member.

6 Claims, 6 Drawing Sheets

DEVELOPER SUPPLY DEVICE AND IMAGE FORMING APPARATUS HAVING THE SAME

CROSS-REFERENCE TO RELATED APPLICATION

This application claims priority under 35 U.S.C. §119 from Japanese Patent Application No. 2010-124070 filed on May 31, 2010. The entire subject matter of the application is incorporated herein by reference.

BACKGROUND

1. Technical Field

The following description relates to one or more developer supply devices configured to supply charged powdered development agent to an intended device.

2. Related Art

A developer supply device has been known that includes a developer holding member (a development roller), an upstream developer transfer unit, and a downstream developer transfer unit.

The developer holding member is disposed to face an electrostatic latent image holding body (a photoconductive drum) in a predetermined development area. The developer holding member has a developer holding surface on which charged development agent is held and carried.

The upstream developer transfer unit has an upstream transfer surface, which is disposed upstream relative to the development area in a moving direction of the developer holding surface (i.e., in a rotational direction of the development roller) so as to face the developer holding surface across a predetermined distance. The upstream developer transfer unit is configured to generate an upstream transfer electric field (i.e., an electric field for transferring the development agent held on the upstream transfer surface from an upstream side to a downstream side in the moving direction of the developer holding member).

The downstream developer transfer unit has a downstream transfer surface, which is disposed downstream relative to the development area in the moving direction of the developer holding surface so as to face the developer holding surface across a predetermined distance. The upstream developer transfer unit is configured to generate a downstream transfer electric field (i.e., an electric field for transferring the development agent held on the downstream transfer surface from an upstream side to a downstream side in the moving direction of the developer holding member).

In the above configuration, the electric fields, for transferring the charged development agent from an upstream side to a downstream side in the moving direction of the developer holding member, are generated in spaces on the upstream transfer surface and the downstream transfer surface. Thereby, the development agent is transferred, on each of the upstream transfer surface and the downstream transfer surface, from the upstream side to the downstream side in the moving direction of the developer holding member.

The development agent, conveyed by the upstream developer transfer unit, is transferred onto the developer holding surface in a position where the upstream transfer surface faces the developer holding surface (i.e., a circumferential surface of the development roller). Thereby, the development agent adheres to the developer holding surface. Namely, the development agent is held and carried on the developer holding surface.

A part of the development agent held on the developer holding surface is supplied and consumed in the development area to develop an electrostatic latent image. In other words, when reaching the development area, the development agent held on the developer holding surface partially adheres to positions, corresponding to the electrostatic latent image, on an electrostatic latent image holding surface that is a circumferential surface of the electrostatic latent image holding body.

The remaining part, of the development agent held on the developer holding surface, which has not adhered to the electrostatic latent image holding surface (i.e., which has not been consumed in the development area), is retrieved by the downstream developer transfer unit, and then transferred, on the downstream transfer surface, from the upstream side to the downstream side in the moving direction of the developer holding surface.

SUMMARY

However, in the developer supply device of this kind, when the remaining development agent, which is left on the developer holding surface without being consumed in the development area, is not retrieved in a favorable manner, it might result in a lowered quality of formed image.

Aspects of the present invention are advantageous to provide one or more improved techniques for a developer supply device, which techniques make it possible to retrieve development agent remaining on the developer holding member in a favorable manner.

According to aspects of the present invention, a developer supply device is provided, which is configured to supply charged development agent to an intended device. The developer supply device includes a developer holding member including a developer holding surface that is formed as a cylindrical circumferential surface parallel to a first direction and disposed to face the intended device in a first position, the developer holding member being configured to rotate around an axis parallel to the first direction such that the developer holding surface moves in a second direction perpendicular to the first direction, a developer transfer unit that includes an electric-field transfer board including a plurality of transfer electrodes each of which is elongated in a longitudinal direction thereof parallel to the first direction, the transfer electrodes being arranged along a direction perpendicular to the first direction, the electric-field transfer board being configured to generate a traveling-wave electric field when a transfer bias that is a multi-phase alternating-current voltage is applied to the transfer electrodes, the developer transfer unit being configured to, under the traveling-wave electric field generated by the electric-field transfer board, convey the development agent to the developer holding member and transfer the conveyed development agent onto the developer holding surface in a second position upstream relative to the first position in the second direction such that the developer holding surface holds and carries thereon the transferred development agent, and a developer retrieving member disposed to face the developer holding surface across a predetermined distance in a third position downstream relative to the first position in the second direction, the developer retrieving member being driven to rotate around an axis parallel to the first direction, the developer retrieving member being configured to retrieve the development agent from the developer holding surface under a retrieving electric field that is generated when a retrieving voltage is applied between the developer retrieving member and the developer holding member.

According to aspects of the present invention, further provided is an image forming apparatus that includes a photoconductive body configured such that a development agent image is formed thereon, and a developer supply device configured to supply charged development agent to the photoconductive body. The developer supply device includes a developer holding member that comprises a developer holding surface that is formed as a cylindrical circumferential surface parallel to a first direction and disposed to face the photoconductive body in a first position, the developer holding member being configured to rotate around an axis parallel to the first direction such that the developer holding surface moves in a second direction perpendicular to the first direction, a developer transfer unit that includes an electric-field transfer board comprising a plurality of transfer electrodes each of which is elongated in a longitudinal direction thereof parallel to the first direction, the transfer electrodes being arranged along a direction perpendicular to the first direction, the electric-field transfer board being configured to generate a traveling-wave electric field when a transfer bias that is a multi-phase alternating-current voltage is applied to the transfer electrodes, the developer transfer unit being configured to, under the traveling-wave electric field generated by the electric-field transfer board, convey the development agent to the developer holding member and transfer the conveyed development agent onto the developer holding surface in a second position upstream relative to the first position in the second direction such that the developer holding surface holds and carries thereon the transferred development agent, and a developer retrieving member disposed to face the developer holding surface across a predetermined distance in a third position downstream relative to the first position in the second direction, the developer retrieving member being driven to rotate around an axis parallel to the first direction, the developer retrieving member being configured to retrieve the development agent from the developer holding surface under a retrieving electric field that is generated when a retrieving voltage is applied between the developer retrieving member and the developer holding member.

BRIEF DESCRIPTION OF THE ACCOMPANYING DRAWINGS

Figure 4:
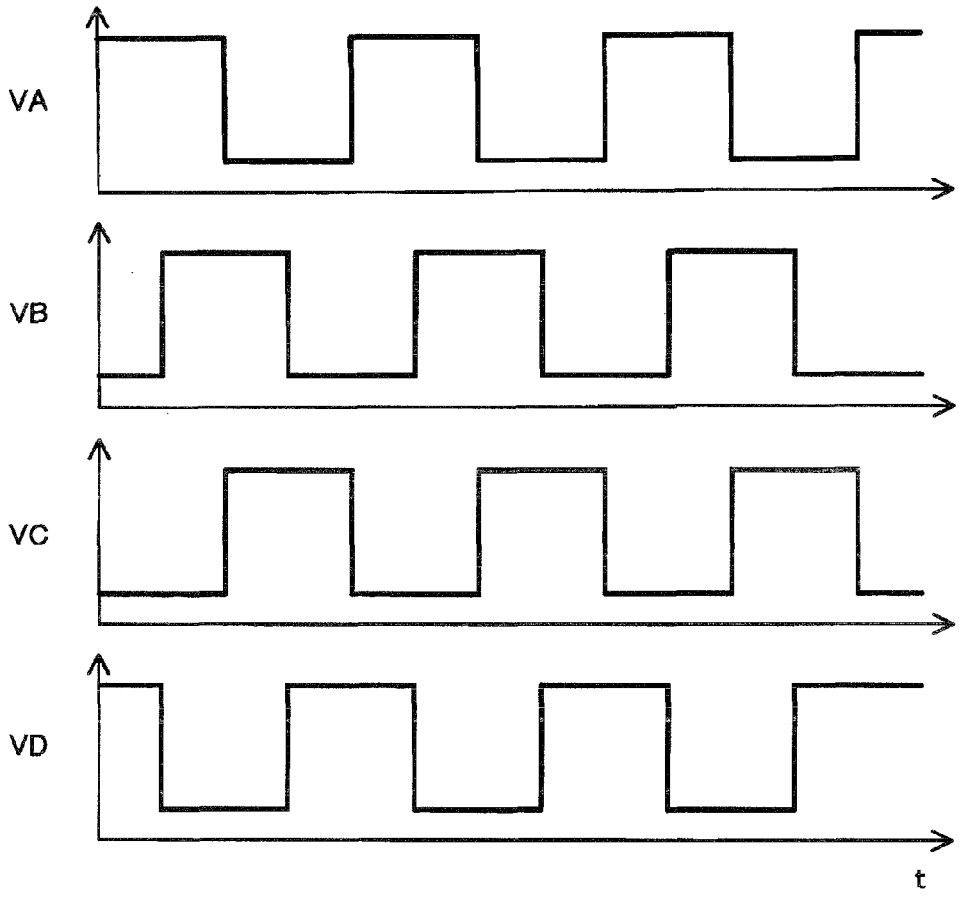

FIG. 4 exemplifies a waveform of an output voltage generated by each power supply circuit for the transfer board in the embodiment according to one or more aspects of the present invention.

FIGS. 5A to 5D schematically illustrate behaviors of particle(s) of powdered toner.

Figure 6:
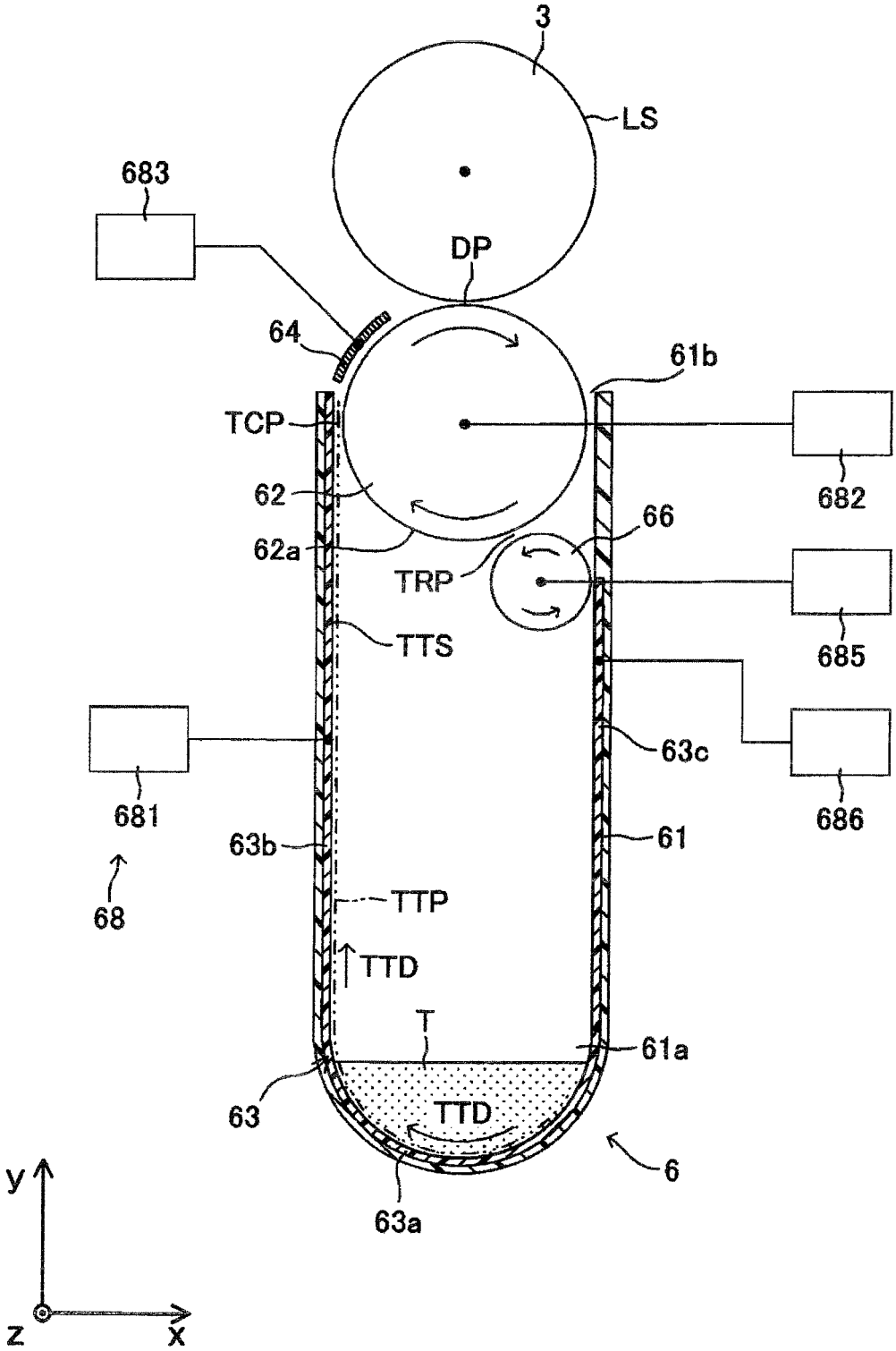

FIG. 6 is an enlarged cross-sectional side view of a toner supply device for the laser printer in a modification according to one or more aspects of the present invention.

DETAILED DESCRIPTION

It is noted that various connections are set forth between elements in the following description. It is noted that these connections in general and, unless specified otherwise, may be direct or indirect and that this specification is not intended to be limiting in this respect.

Hereinafter, an embodiment according to aspects of the present invention will be described with reference to the accompany drawings.

<Configuration of Laser Printer>

Figure 1:
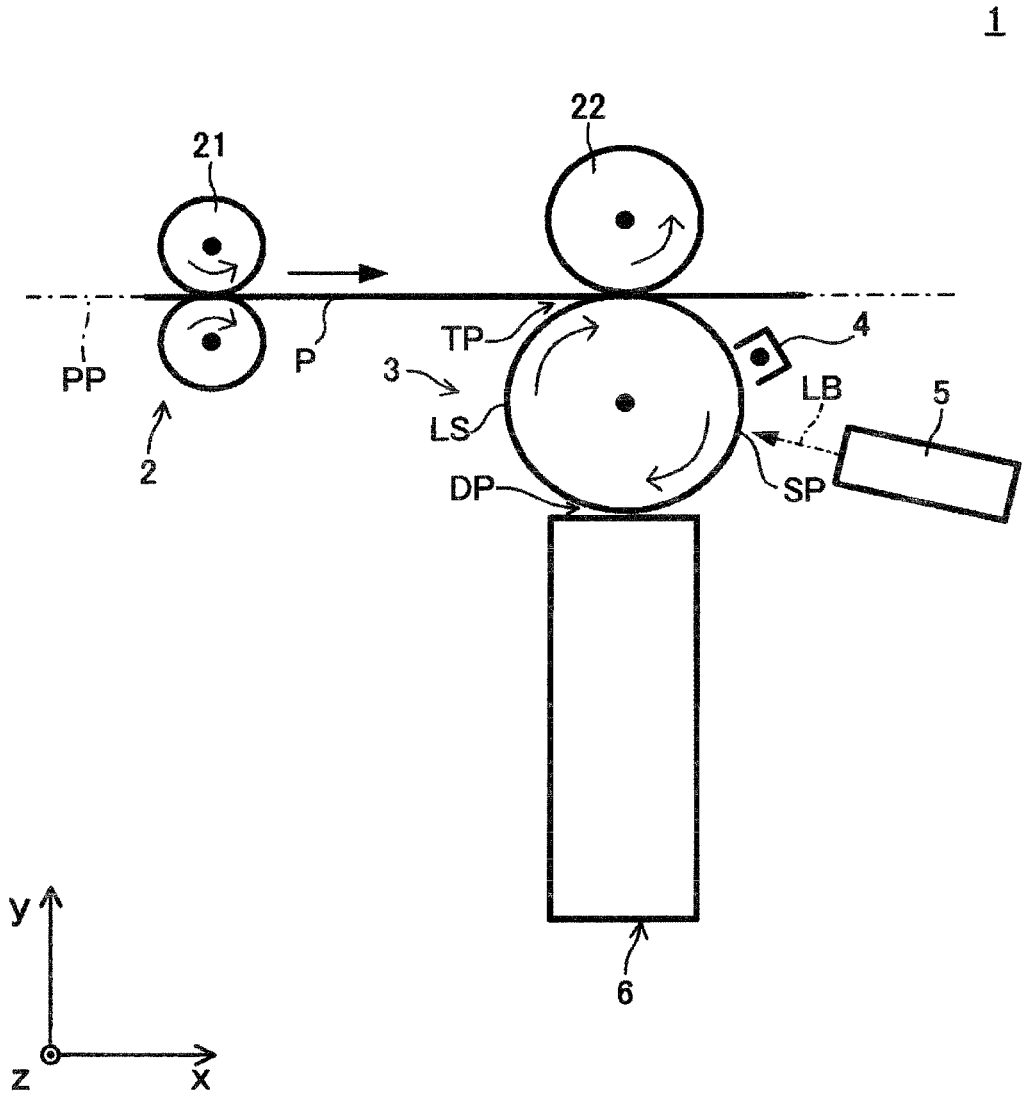
FIG. 1 is a side view schematically showing a configuration of a laser printer in an embodiment according to one or more aspects of the present invention.

As illustrated in FIG. 1, a laser printer 1 includes a sheet feeding mechanism 2, a photoconductive drum 3, an electrification device 4, a scanning unit 5, and a toner supply device 6. A feed tray (not shown), provided in the laser printer 1, is configured such that a stack of sheets P is placed thereon. The sheet feeding mechanism 2 is configured to feed a sheet P along a predetermined sheet feeding path PP.

On a circumferential surface of the photoconductive drum 3, an electrostatic latent image holding surface LS is formed as a cylindrical surface parallel to a main scanning direction (i.e., a z-axis direction in FIG. 1). The electrostatic latent image holding surface LS is configured such that an electrostatic latent image is formed thereon in accordance with an electric potential distribution. Further, the electrostatic latent image holding surface LS is configured to hold toner T (see FIG. 2) in positions corresponding to the electrostatic latent image. The photoconductive drum 3 is driven to rotate in the direction indicated by arrows (clockwise) in FIG. 1 around an axis parallel to the main scanning direction. Thus, the photoconductive drum 3 is configured to move the electrostatic latent image holding surface LS along an auxiliary scanning direction perpendicular to the main scanning direction.

The electrification device 4 is disposed to face the electrostatic latent image holding surface LS. The electrification device 4, which is of a corotron type or a scorotron type, is configured to positively charge the electrostatic latent image holding surface LS in an even manner.

The scanning unit 5 is configured to generate a laser beam LB modulated based on image data. Specifically, the scanning unit 5 generates the laser beam LB within a predetermined wavelength range, which laser beam LB is emitted under ON/OFF control depending on whether there is a pixel in a target location on the image data. In addition, the scanning unit 5 converges the laser beam LB in a scanned position SP on the electrostatic latent image holding surface LS, and forms the electrostatic latent image on the electrostatic latent image holding surface LS, while moving (scanning) the position where the laser beam LB is converged on the electrostatic latent image holding surface LS, along the main scanning direction at a constant speed. Here, the scanned position SP is set in a downstream position relative to the electrification device 4 in the rotational direction of the photoconductive drum 3 (i.e., the clockwise direction indicated by the arrows in FIG. 1).

The toner supply device 6 is disposed under the photoconductive body 3 so as to face the photoconductive body 3. The toner supply device 6 is configured to supply the charged toner T (see FIG. 2), in a development position DP, onto the photoconductive drum 3 (the electrostatic latent image holding surface LS). It is noted that the development position DP denotes a position where the toner supply device 6 faces the electrostatic latent image holding surface LS in closest proximity thereto. A detailed explanation will be provided later about the configuration of the toner supply device 6.

Subsequently, a detailed explanation will be provided about a specific configuration of each element included in the laser printer 1.

The sheet feeding mechanism 2 includes a pair of registration rollers 21, and a transfer roller 22. The registration rollers 21 are configured to feed a sheet P toward between the photoconductive drum 3 and the transfer roller 22 at a predetermined moment. The transfer roller 22 is disposed to face the electrostatic latent image holding surface LS (i.e., the outer circumferential surface of the photoconductive drum 3) across the sheet feeding path PP in a transfer position TP. Additionally, the transfer roller 22 is driven to rotate in a counterclockwise direction indicated by an arrow in FIG. 1. The transfer roller 22 is connected to a bias power supply circuit (not shown). Specifically, the transfer roller 22 is configured such that a predetermined transfer bias voltage is applied between the transfer roller 22 and the photoconductive drum 3 so as to transfer, onto the sheet P, the toner T (see FIG. 2) which adheres onto the electrostatic latent image holding surface LS.

<<Toner Supply Device>>

Figure 2:
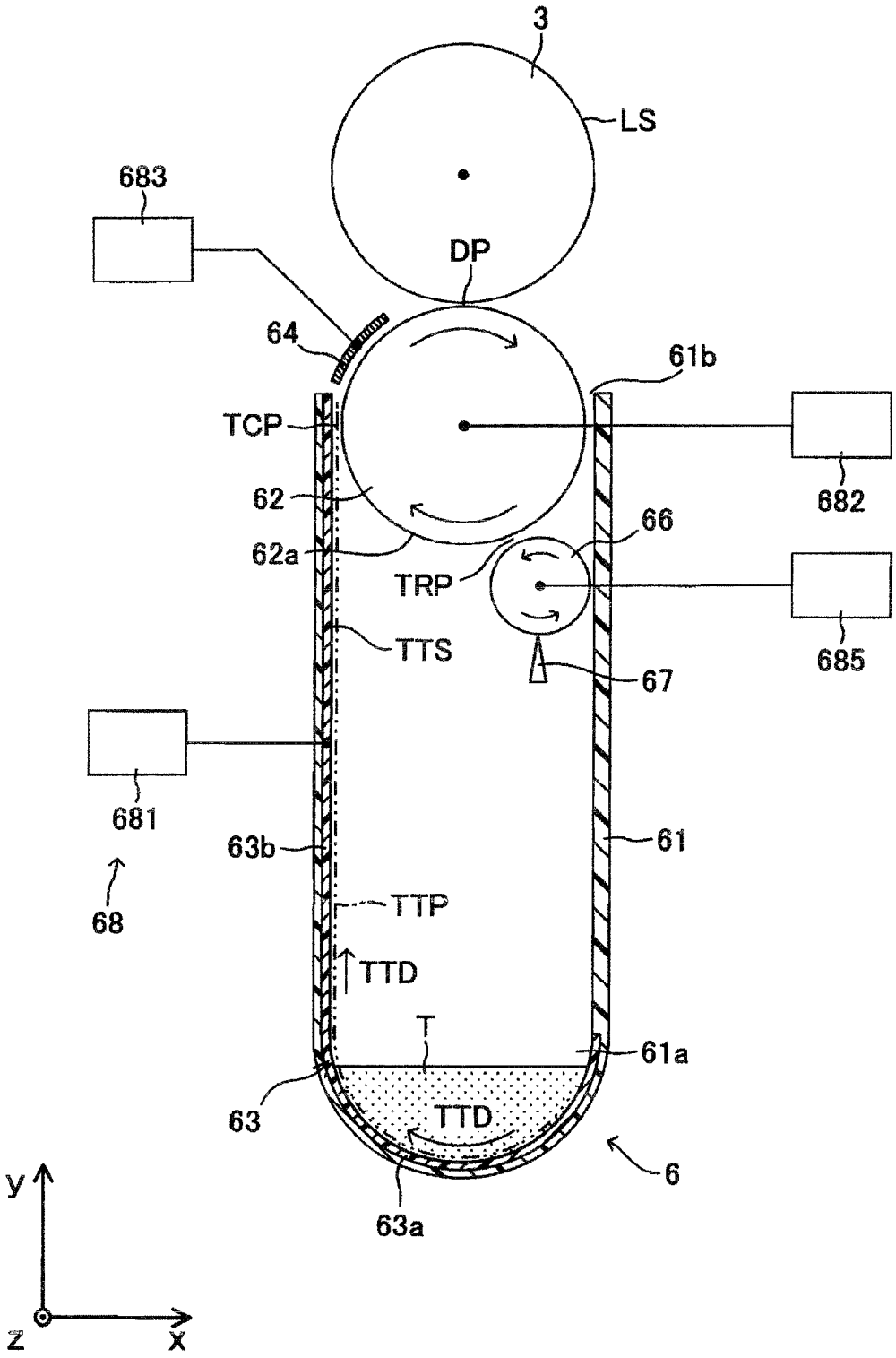
FIG. 2 is an enlarged cross-sectional side view of a toner supply device for the laser printer in the embodiment according to one or more aspects of the present invention.

As depicted in FIG. 2 that is a cross-sectional side view (along a plane with the main scanning direction as a normal line) of the toner supply device 6, a toner box 61, which forms a casing of the toner supply device 6, is a box member that is formed substantially in a U-shape when viewed in the z-axis direction. Further, the toner box 61 is disposed to have a longitudinal direction thereof that is parallel to an up-to-down (vertical) direction (i.e., the y-axis direction in FIG. 2).

The toner box 61 is configured to accommodate the toner T (dry-type powdered development agent). Specifically, the toner T is held in a toner storage section 61*a* that is a space formed inside a substantially half-cylinder-shaped bottom section of the toner box 61. It is noted that in the embodiment, the toner T is positively-chargeable nonmagnetic-one-component black toner. Further, the toner box 61 has an opening 61*b* formed in such a position at a top of the toner box 61 as to face the photoconductive drum 3. In other words, the opening 61*b* is provided to open up toward the photoconductive drum 3.

The development roller 62 is a roller-shaped member having a toner holding surface 62*a* that is a cylindrical circumferential surface. The development roller 62 is disposed to face the photoconductive drum 3. Specifically, the development roller 62 is disposed in a position where the toner holding surface 62*a* thereof faces the electrostatic latent image holding surface LS of the photoconductive drum 3 across a predetermined gap in the development position DP.

The development roller 62 is rotatably supported at an upper end portion of the toner box 61 where the opening 61*b* is formed. In the embodiment, the development roller 62 is housed in the toner box 61 such that a rotational central axis, parallel to the main scanning direction, of the development roller 62 is located inside the toner box 61 and thereby substantially an upper half of the toner holding surface 62*a* is exposed to the outside of the toner box 61.

Inside the toner box 61, an electric-field transfer board 63 is provided along a toner transfer path TTP that is formed in shape of mirror-inverted "J" when viewed in the z-axis direction. The electric-field transfer board 63 is configured to transfer the toner T with a traveling-wave electric field, on a toner transfer surface TTS along the toner transfer path TTP. In the embodiment, the electric-field transfer board 63 includes a bottom electric-field transfer board 63*a*, and a vertical electric-field transfer board 63*b*. It is noted that a detailed explanation will be provided later about an internal configuration of the electric-field transfer board 63.

The bottom electric-field transfer board 63*a* is fixed onto the inner wall surface of the toner box 61 in a bottom region of an inner space of the toner box 61. The bottom electric-field transfer board 63*a* is a hollow-shaped curved plate member that is curved in a shape of a half-cylinder open up when viewed in the z-axis direction as shown in FIG. 2. Further, the bottom electric-field transfer board 63*a* is smoothly connected with a lower end of the flat-plate vertical electric-field transfer board 63*b*, so as to smoothly transfer the toner T stored in the toner storage section 61*a* toward the lower end of the vertical electric-field transfer board 63*b*.

The vertical electric-field transfer board 63*b* is fixed onto the inner wall surface of the toner box 61. The vertical electric-field transfer board 63*b* is provided to transfer the toner T vertically upward from the lower end thereof connected with the bottom electric-field transfer, board 63*a*. The vertical electric-field transfer board 63*b* has an upper end (i.e., a downstream end in a toner transfer direction TTD: the toner transfer direction TTD is a tangential direction in a given position on the toner transfer path TTP) that is provided substantially as high as a center of the development roller 62 (more specifically, the upper end is provided up to a point slightly higher than the center of the development roller 62). The upper end of the vertical electric-field transfer board 63*b* faces the toner holding surface 62*a* as a cylindrical surface of the development roller 62. There is a gap of a predetermined distance between the upper end of the vertical electric-field transfer board 63*b* and the toner holding surface 62*a*, in a toner carrying position TCP where the upper end of the vertical electric-field transfer board 63*b* and the toner holding surface 62*a* face each other in closest proximity to each other.

In the embodiment, the bottom electric-field transfer board 63*a* and the vertical electric-field transfer board 63*b* are formed integrally in a seamless manner. The electric-field transfer board 63 is configured to transfer the toner T stored in the toner storage section 61*a* toward the toner carrying position TCP, which is upstream relative to the development position DP in the moving direction of the toner holding surface 62*a* moving when the development roller 62 rotates, in the toner transfer direction TTD.

An auxiliary electrification electrode 64 is disposed to face the toner holding surface 62*a*, in a position between the toner carrying position TCP and the development position DP in the moving direction of the toner holding surface 62*a*. The auxiliary electrification electrode 64 is configured to charge the toner T held on the toner holding surface 62*a* by the action of an alternating-current (AC) electric field generated between the auxiliary electrification electrode 64 and the toner holding surface 62*a*. In the embodiment, the auxiliary electrification electrode 64 is an arc-shaped plate member provided concentrically when viewed in the z-axis direction, and formed from a metal plate (e.g., a stainless steel plate). There is a gap of a predetermined distance between the auxiliary electrification electrode 64 and the toner holding surface 62*a*.

A retrieving roller 66 is driven to rotate around an axis parallel to the main scanning direction. The retrieving roller 66 is disposed to face the development roller 62 across a predetermined distance, in a toner retrieving position TRP between the development position DP and the toner carrying position TCP (i.e., in a position downstream relative to the development position DP and upstream relative to the toner carrying position TCP) in the moving direction of the toner holding surface 62*a*.

Further, the retrieving roller 66 is configured such that a predetermined retrieving voltage is applied between the retrieving roller 66 and the development roller 62. Namely, the retrieving roller 66 retrieves the toner T from toner holding surface 62*a* by the action of a retrieving electric field generated when the retrieving voltage is applied. It is noted that in the embodiment, the retrieving roller 66 is driven to rotate in a direction opposite to the rotational direction of the development roller 62, so as to make a moving direction of a circumferential surface thereof in the toner retrieving position TRP identical to the moving direction of the toner holding surface 62*a*.

Beneath the retrieving roller 66, a removal blade 67 is disposed to contact (slide in contact with) the circumferential surface of the retrieving roller 66, in a position opposite the toner retrieving position TRP with respect to the rotational center axis of the retrieving roller 66 (i.e., in a downstream position relative to the toner retrieving position TRP in the moving direction of the circumferential surface of the retrieving roller 66. The removal blade 67 removes, from the circumferential surface of the retrieving roller 66, the toner T retrieved from the toner holding surface 62*a* by the retrieving roller 66.

Further, the toner supply device 6 includes a bias supply unit 68. The bias supply unit 68 is configured to apply a predetermined voltage to the development roller 62, the electric-field transfer board 63, the auxiliary electrification electrode 64, and the retrieving roller 66. The bias supply unit 68 will be described in detail below.

<<<Internal Configuration of Transfer Board>>>

Figure 3:
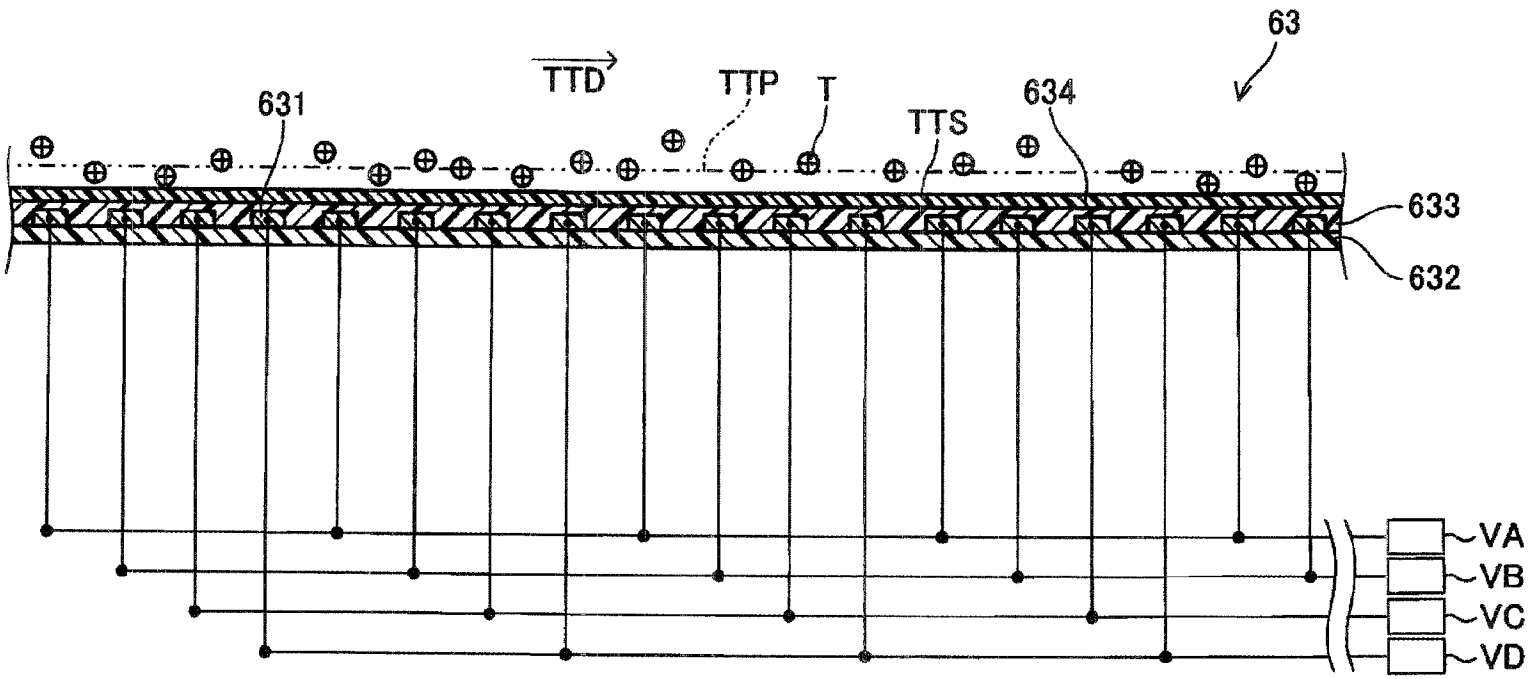
FIG. 3 is an enlarged cross-sectional side view of a transfer board for the toner supply device in the embodiment according to one or more aspects of the present invention.

Referring to FIG. 3, the electric-field transfer board 63 is a thin plate member configured in the same manner as a flexible printed-circuit board. Specifically, the electric-field transfer board 63 includes a plurality of transfer electrodes 631, a supporting film layer 632, an electrode coating layer 633, and an overcoating layer 634.

The transfer electrodes 631 are linear wiring patterns elongated in a direction parallel to the main scanning direction. For example, the transfer electrodes 631 may be formed with copper thin films. The transfer electrodes 631 are arranged along the toner transfer path TTP so as to be parallel to each other.

Every fourth one of the transfer electrodes 631, arranged along the toner transfer path TTP, is connected with a specific one of four power supply circuits VA, VB, VC, and VD. In other words, the transfer electrodes 631 are arranged along the toner transfer path TTP in the following order: a transfer electrode 631 connected with the power supply circuit VA, a transfer electrode 631 connected with the power supply circuit VB, a transfer electrode 631 connected with the power supply circuit VC, a transfer electrode 631 connected with the power supply circuit VD, a transfer electrode 631 connected with the power supply circuit VA, a transfer electrode 631 connected with the power supply circuit VB, a transfer electrode 631 connected with the power supply circuit VC, a transfer electrode 631 connected with the power supply circuit VD, . . . .

FIG. 4 exemplifies output waveforms, which are respectively generated by the power supply circuits VA, VB, VC, and VD shown in FIG. 3. In the embodiment, as illustrated in FIG. 4, the power supply circuits VA, VB, VC, and VD are configured to generate respective AC driving voltages having substantially the same waveform. Further, the power supply circuits VA, VB, VC, and VD are configured to generate the respective AC driving voltages with a phase difference of 90 degrees between any adjacent two of the power supply circuits VA, VB, VC, and VD in the aforementioned order. In other words, the power supply circuits VA, VB, VC, and VD are configured to output the respective AC driving voltages each of which is delayed by a phase of 90 degrees behind the voltage output from a precedent adjacent one of the power supply circuits VA, VB, VC, and VD in the aforementioned order. Thus, the electric-field transfer board 63 is configured to transfer the positively charged toner T in the toner transfer direction TTD when the aforementioned driving voltages (transfer bias voltages) are applied to the transfer electrodes 631 and a traveling-wave electric field is generated along the toner transfer surface TTS.

The transfer electrodes 631 are formed on a surface of the supporting film layer 632. The supporting film layer 632 is a flexible film made of electrically insulated synthetic resin such as polyimide resin. The electrode coating layer 633 is made of electrically insulated synthetic resin. The electrode coating layer 633 is provided to coat the transfer electrodes 631 and a surface of the supporting film layer 632 on which the transfer electrodes 631 are formed. On the electrode coating layer 633, the overcoating layer 634 is provided. Namely, the electrode coating layer 633 is formed between the overcoating layer 634 and the transfer electrodes 631. The surface of the overcoating layer 634 (i.e., the toner transfer surface TTS) is formed as a smooth surface with a very low level of irregularity, so as to smoothly convey the toner T.

<<<Bias Supply Unit>>>

Referring back to FIG. 2, the bias supply unit 68 includes a transfer bias power supply circuit 681, a development bias power supply circuit 682, an auxiliary electrification bias power supply circuit 683, and a retrieving bias power supply circuit 685.

The transfer bias power supply circuit 681 is electrically connected with the electric-field transfer board 63. The transfer bias power supply circuit 681 is configured to apply, to the transfer electrodes 631 of the electric-field transfer board 63, a transfer bias for transferring the toner T to the toner carrying position TCP along the toner transfer path TTP. It is noted that the transfer bias power supply circuit 681 includes the four power supply circuits VA, VB, VC, and VD.

The development bias power supply circuit 682 is electrically connected with the development roller 62. The development bias power supply circuit 682 is configured to apply a development bias to the development roller 62. The development bias is appropriately set to make the toner T held on the toner holding surface 62*a* after transferring the toner T from the toner transfer surface TTS to the toner holding surface 62*a* in the toner carrying position TCP, and to make the toner T jump in the development position DP.

The auxiliary electrification bias power supply circuit 683 is electrically connected with the auxiliary electrification electrode 64. The auxiliary electrification bias power supply circuit 683 is configured to apply an auxiliary electrification bias to the auxiliary electrification electrode 64. The auxiliary electrification bias is appropriately set to make the toner T remain on the toner holding surface 62*a* while rendering the toner T more charged by making the toner T vibrate and collide against a surface of the auxiliary electrification electrode 64 in a position where the development roller 62 (the toner holding surface 62*a*) faces the auxiliary electrification electrode 64. Specifically, the auxiliary electrification bias power supply circuit 683 is configured to apply a direct-current (DC) voltage component to the auxiliary electrification electrode 64, so as to generate an AC electric field between the development roller 62 and the auxiliary electrification electrode 64 by an AC voltage component supplied from the development bias power supply circuit 682.

The retrieving bias power supply circuit 685 is electrically connected with the retrieving roller 66. The retrieving bias power supply circuit 685 is configured to apply a retrieving bias to the retrieving roller 62. The retrieving bias is appropriately set to generate a voltage potential difference (the retrieving voltage) between the development roller 62 and the retrieving roller 66 in the toner retrieving position TRP and accordingly make the retrieving roller 66 retrieve the toner T from the toner holding surface 62*a*.

<<<Specific Example>>>

Specifically, the transfer bias power supply circuit 681 is configured to output the transfer bias (+500 to +1100 V), which contains a DC voltage component of +800 V and a multi-phase AC voltage component with an amplitude of 300 V and a frequency of 300 Hz. There is a gap of 0.5 mm provided in the toner carrying position TCP between the development roller 62 (the toner holding surface 62*a*) and the electric-field transfer board 63.

The development roller 62 is made of aluminum with a diameter of 20 mm. The development bias power supply circuit 682 is configured to output the development bias (−800 to +1800 V), which contains a DC voltage component of +500 V and an AC voltage component with an amplitude of 1300 V and a frequency of 2 kHz.

The auxiliary electrification electrode 64 is formed with a stainless steel plate curved substantially in an arc shape, and has a length of 9 mm at the time when viewed in the z-axis direction. There is a gap of 0.3 mm provided between the development roller 62 (the toner holding surface 62*a*) and the auxiliary electrification electrode 64. The auxiliary electrification bias power supply circuit 683 is configured to output the auxiliary electrification bias containing only a DC voltage component of +640 V.

The retrieving roller 66 is made of aluminum and formed with a diameter of 11 mm. There is a gap of 0.7 mm provided in the toner retrieving position TRP between the development roller 62 (the toner holding surface 62*a*) and the retrieving roller 66. The retrieving bias power supply circuit 685 is configured to output the retrieving bias (−1300 to +1300 V), which contains a DC voltage component of 0 V and an AC voltage component with an amplitude of 1300 V and a frequency of 2 kHz.

Further, in the example, the retrieving bias power supply circuit 685 is configured to generate the retrieving bias with a phase difference of 180 degrees (a half wavelength) from the development bias. Thereby, at the gap in the vicinity of the toner retrieving position TRP, generated is such an electric field that the positively charged toner T transfers to the retrieving roller 66 while vibrating between the retrieving roller 66 and the development roller 62 (the toner holding surface 62*a*), by the retrieving voltage (which is a voltage potential difference generated between the development roller 62 and the retrieving roller 66 based on the development bias and the retrieving bias) containing a DC voltage component and an AC voltage component.

<Operations of Laser Printer>

Subsequently, a general overview will be provided of operations of the laser printer 1 configured as above with reference to the relevant drawings.

<<Sheet Feeding Operation>>

Referring to FIG. 1, firstly, a leading end of a sheet P placed on the feed tray (not shown) is fed to the registration rollers 21. The registration rollers 21 perform skew correction for the sheet P, and adjust a moment when the sheet P is to be fed forward. After that, the sheet P is fed to the transfer position TP.

<<Formation of Toner Image on Electrostatic Latent Image Holding Surface>>

While the sheet P is being conveyed to the transfer position TP as described above, an image of the toner T (hereinafter referred to as a toner image) is formed on the electrostatic latent image holding surface LS that is the outer circumferential surface of the photoconductive drum 3, as will be mentioned below.

<<Formation of Electrostatic Latent Image>>

Firstly, the electrostatic latent image holding surface LS of the photoconductive drum 3 is charged evenly and positively by the electrification device 4. The electrostatic latent image holding surface LS, charged by the electrification device 4, is moved along the auxiliary scanning direction to the scanned position SP to face the scanning unit 5, when the photoconductive drum 3 rotates in the clockwise direction shown by arrows in FIG. 1.

In the scanned position SP, the electrostatic latent image holding surface LS is exposed to the laser beam LB that is modulated based on the image data. Namely, while being scanned along the main scanning direction, the laser beam LB is rendered incident onto the electrostatic latent image holding surface LS. In accordance with the modulation of the laser beam LB, areas with no positive charge remaining thereon are generated on the electrostatic latent image holding surface LS. Thereby, an electrostatic latent image is formed with a positive charge pattern (positive charges distributed in the shape of an image) on the electrostatic latent image holding surface LS. The electrostatic latent image, formed on the electrostatic latent image holding surface LS, is transferred to the development position DP to face the toner supply device 6 when the photoconductive drum 3 rotates in the clockwise direction indicated by the arrows in FIG. 1.

<<Transfer and Supply of Charged Toner>>

Referring to FIGS. 2 and 3, the toner T stored in the toner box 61 is charged due to contact and/or friction with the overcoating layer 634 on the bottom electric-field transfer board 63*a*. The charged toner T, which is in contact with or proximity to the overcoating layer 634 on the bottom electric-field transfer board 63*a*, is conveyed in the toner transfer direction TTD, by the traveling-wave electric field generated when the aforementioned transfer bias, containing the multi-phase AC voltage component, is applied to the bottom transfer electrodes 631*a*. Thereby, the charged toner T is smoothly transferred to the vertical electric-field transfer board 63*b*.

The vertical electric-field transfer board 63*b* conveys the toner T, received at the lower end of the vertical electric-field transfer board 63*b* from the bottom electric-field transfer board 63*a*, vertically up toward toner carrying position TCP, by the traveling-wave electric field generated when the aforementioned transfer bias voltages are applied to the transfer electrodes 631 of the vertical electric-field transfer board 63*b*.

Here, the toner T transferred from the bottom electric-field transfer board 63*a* to the vertical electric-field transfer board 63*b* contains toner charged in an undesired manner as well (e.g., negatively charged toner, inadequately charged toner, and uncharged toner). Nonetheless, in the embodiment, inappropriately charged toner leaves the toner transfer path TTP and drops from the vertical electric-field transfer board 63*b* by the action of the gravity and/or the aforementioned electric fields, when being conveyed vertically up toward the toner carrying position, TCP by the vertical electric-field transfer board 63*b*, or being held and carried on the development roller 62 in the vicinity of the toner carrying position TCP by the electric field generated between the vertical electric-field transfer board 63*b* and the development roller 62.

Thereby, it is possible to selectively convey adequately charged toner T to the toner carrying position TCP. Namely, it is possible to discriminate adequately charged toner T from inappropriately charged toner T by the vertical electric-field transfer board 63*b*, in a favorable manner. The toner T, which has left the toner transfer path TTP and dropped, returns into the toner storage section 61*a*.

In the aforementioned manner, the positively charged toner T is transferred to the toner carrying position TCP by the vertical electric-field transfer board 63*b*. During this time period, a charged level (the amount of the charges) of the toner T gradually rises due to contact between the toner T and the toner transfer surface TTS.

The toner T, transferred to the toner carrying position TCP by the vertical electric-field transfer board 63*b*, is held and carried on the toner holding surface 62*a* in the vicinity of the toner carrying position TCP, by the action of the transfer bias and the development bias. Then, when the development roller 62 is driven to rotate and the toner holding surface 62*a* moves to the development position DP, the toner T is supplied to the development position DP. In the vicinity of the development position DP, the electrostatic latent image formed on the electrostatic latent image holding surface LS is developed with the toner T by the action of the development bias. Namely, the toner T is transferred from the toner holding surface 62*a*, and adheres to the areas with no positive charge on the electrostatic latent image holding surface LS. Thereby, the toner image (i.e., the image of the toner) is formed and held on the electrostatic latent image holding surface LS.

The inventors of the present invention has found a problem that in a known toner supply device of this kind, the efficiency in transferring the toner T from the toner holding surface 62*a* to the electrostatic, latent image holding surface LS (i.e., the development efficiency in developing the electrostatic latent image or the efficiency in supplying the toner T to the electrostatic latent image) is not sufficient. The problem is considered to result from the toner T too firmly adhering onto the toner holding surface 62*a*.

Figure 5A:
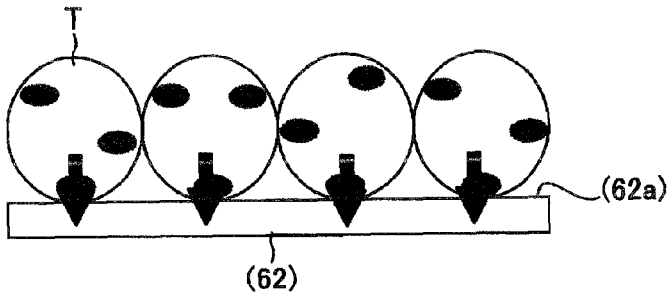

As illustrated in FIG. 5A, in a usual nonmagnetic-one-component development device (a device configured to make the development roller 62 hold thereon the charged toner T with a sponge roller or a blade), as the toner T is charged by friction between the development roller 62 and the sponge roller or the blade, it is assumed that charged positions (see gray filled portions in FIG. 5A) in the toner T are evenly dispersed.

Figure 5B:
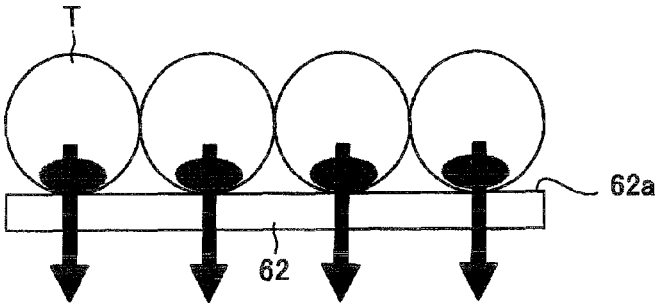

Meanwhile, as depicted in FIG. 5B, in the known electric-field toner supply device of this kind, it is assumed that charged positions in the toner T are localized (i.e., specific portions in the toner T are charged in a localized manner) for the following reason. Accordingly, in the state as shown in FIG. 5B, an electrostatic adhering force of the toner T is considered to be stronger (see downward arrows in FIG. 5B), in comparison with the state as shown in FIG. 5A.

Figure 5C:
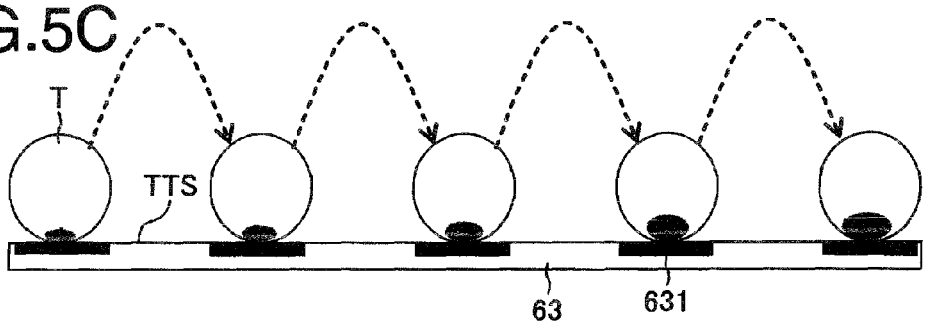

As illustrated in FIG. 5C, when transferred under the electric fields on the electric-field transfer board 63, the toner T travels while hopping along a loop electric flux line (see a dashed line in FIG. 5C). At this time, the toner T (each particle of the powdered toner T) hops with a specific charged position (i.e., the most charged position) thereof as a leading head. Therefore, the specific position of the toner T collides against the toner transfer surface TTS in the most frequent manner, and is friction-charged. Thus, the specific position is charged up in a localized manner while being transferred under the electric fields on the electric-field transfer board 63.

Figure 5D:
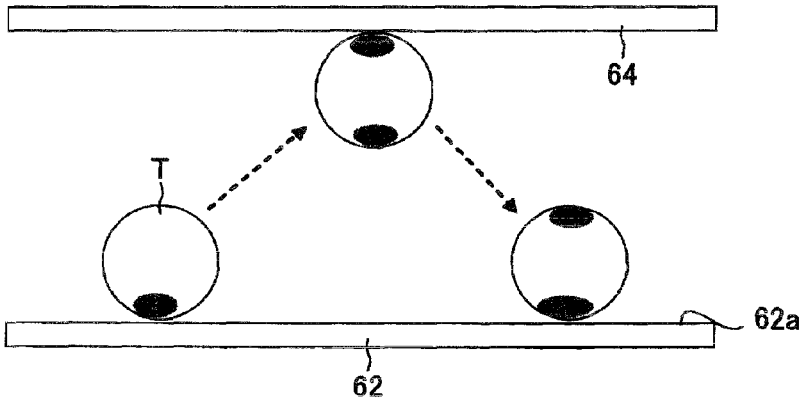

On the contrary, in the embodiment, the toner T, which is once held in a charged state as shown in FIG. 5B in the vicinity of the toner carrying position TCP on the toner holding surface 62*a*, is charged when oscillated with a large amplitude by the action of a relatively strong alternating electric field as shown in FIG. 5D in the position where the development roller 62 faces the auxiliary electrification electrode 64 and therefore colliding against the auxiliary electrification electrode 64 (and the development roller 62). Thus, as being charged by the action of the alternating electric field, the toner T is charged more evenly.

Namely, the toner T, which has passed through the position where the development roller 62 faces the auxiliary electrification electrode 64, comes close to the state where the charged positions in the toner T are evenly dispersed as shown in FIG. 5A, by the charging action as shown in FIG. 5D. Thereby, the adhering force of the toner T adhering onto the toner holding surface 62*a* is lessened in comparison with the charged state of the toner T in the known electric-field toner supply device as shown in FIG. 5B. Accordingly, the development efficiency is enhanced in the development position DP, and the below-mentioned retrieving efficiency in retrieving the toner T from the toner holding surface 62*a* by the retrieving roller 66 is improved as well.

The toner T, which has passed through the development position DP and still remains on the toner holding surface 62*a* (without being consumed in the development position DP), reaches (the vicinity of) the toner retrieving position TRP. In the vicinity of the toner retrieving position TRP, the toner T transfers (jumps) onto the retrieving roller 66 by the action of the development bias and the retrieving bias while being oscillated between the retrieving roller 66 and the development roller 62 (the toner holding surface 62*a*).

The retrieving roller 66 rotates while retrieving the toner T from the toner holding surface 62*a*. Then, the toner T adhering to the retrieving roller 66 is removed by the removal blade 67 in a position opposite to the toner retrieving position TRP across the retrieving roller 66, and drops into the toner storage section 61*a*. Therefore, areas on the retrieving roller 66, where the toner T adhering onto the retrieving roller 66 is removed or reduced, sequentially come to the toner retrieving position TRP.

As described above, the retrieving roller 66 rotates in non-contact with the toner holding surface 62*a*. Therefore, an area on the circumferential surface of the retrieving roller 66 that faces the toner retrieving position TRP moves in response to rotation of the retrieving roller 66, without sliding in contact with the toner holding surface 62*a*. Thus, (even though the toner T is not perfectly removed from the retrieving roller 66 by the removal blade 67,) it is possible to prevent the toner T from remaining on the toner holding surface 62*a* in an undesired fashion due to contact or sliding contact between the retrieving roller 66 and the toner holding surface 62*a*.

Thus, in the embodiment, the toner T remaining on the toner holding surface 62*a* is retrieved under an electric field in a non-contact manner, by the retrieving roller 66 that is disposed to face the toner holding surface 62*a* across the aforementioned gap. Therefore, the toner T, which still remains on the toner holding surface 62*a* without being consumed in the development position DP, is retrieved in a favorable manner. Hence, according to the configuration exemplified in the embodiment, it is possible to supply the charged powdered toner T to the photoconductive drum 3 in a more favorable manner.

<<Transfer of Toner Image from Electrostatic Latent Image Holding Surface onto Sheet>>

Referring to FIG. 1, the toner image, which is held on the electrostatic latent image holding surface LS of the photoconductive drum 3 as described above, is conveyed to the transfer position TP when the electrostatic latent image holding surface LS turns in the clockwise direction shown by the arrows in FIG. 1. Then, in the transfer position TP, the toner image is transferred from the electrostatic latent image holding surface LS onto the sheet P.

Hereinabove, the embodiment according to aspects of the present invention has been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only an exemplary embodiment of the present invention and but a few examples of their versatility are shown and described in the present disclosure. It is to be understood that the present invention is capable of use in various other combinations and environments and is capable of changes or modifications within the scope of the inventive concept as expressed herein. For example, the following modifications are feasible.

Aspects of the present invention may be applied to electrophotographic image forming devices such as color laser printers, and monochrome and color copy machines, as well as the single-color laser printer as exemplified in the aforementioned embodiment. Further, the photoconductive body is not limited to the drum-shaped one as exemplified in the aforementioned embodiment. For instance, the photoconductive body may be formed in the shape of a plate or an endless belt.

Additionally, light sources (e.g., LEDs, electroluminescence devices, and fluorescent substances) other than a laser scanner may be employed as light sources for exposure. In such cases, the "main scanning direction" may be parallel to a direction in which light emitting elements such as LEDs are aligned. Namely, the "main scanning direction" may be referred to as a "sheet width direction" (a direction always perpendicular to a sheet feeding direction) or a "device width direction."

Further, for instance, aspects of the present invention may be applied to a configuration with negatively charged development agent and a negatively charged photoconductive body.

Alternatively, aspects of the present invention may be applied to image forming devices employing methods other than the aforementioned electrophotographic method (e.g., a toner-jet method using no photoconductive body, an ion flow method, and a multi-stylus electrode method).

The photoconductive drum 3 may contact the development roller 62.

The electric-field transfer board 63 may be configured without the overcoating layer 634.

A central portion of the bottom electric-field transfer board 63*a* may be flat. Namely, the bottom electric-field transfer board 63*a* may have a curved portion only at a joint where the bottom electric-field transfer board 63*a* is connected with the lower end of the vertical electric-field transfer board 63*b*.

The bottom electric-field transfer board 63*a* may be configured as a board separate from the vertical electric-field transfer board 63*b*. In this case, the bottom electric-field transfer board 63*a* and the vertical electric-field transfer board 63*b* may be connected with respective different power supply circuits.

The vertical electric-field transfer board 63*b* may be slightly tilted as long as it extends substantially along the up-to-down direction.

The toner carrying position TCP where the development roller 62 faces the electric-field transfer board 63 (the vertical electric-field transfer board 63*b*) may not be a position corresponding to the end of the electric-field transfer board 63 (the vertical electric-field transfer board 63*b*).

Instead of the electric-field transfer board 63 and the development bias power supply circuit 682 (and the transfer bias power supply circuit 681), for instance, a supply roller such as a sponge roller may be employed to transfer the development agent in the same manner as the aforementioned usual non-magnetic-one-component development device.

The auxiliary electrification electrode 64 may be formed from a copper plate. Further, the auxiliary electrification electrode 64 may be formed in an arbitrary shape such as shapes of a flat plate, a mesh, and a wire.

The auxiliary electrification electrode 64 may be configured with a rotatable roller-shaped member. In this case, a cleaning mechanism may be provided to remove toner T adhering onto a circumferential surface of the roller-shaped member.

The toner T may not necessarily be charged by the entire transfer path up to the toner carrying position TCP that includes the bottom electric-field transfer board 63*a* and the vertical electric-field transfer board 63*b*. For instance, the material for the overcoating layer 634 of the vertical electric-field transfer board 63*b* may appropriately selected so as to restrain, as much as possible, the toner T from being charged while being conveyed on the vertical electric-field transfer board 63*b*.

In this case, the toner T may be charged mainly at an upstream end of the toner transfer path TTP (i.e., the bottom electric-field transfer board 63*a*). Even in such a case, as the toner T is charged by the action of the alternating electric field in the position where the development roller 62 and the auxiliary electrification electrode 64, it is possible to reduce as efficiently as possible the ratio of the inadequately charged toner T (e.g., uncharged or low-charged toner T) in the development position DP.

The aforementioned various biases may be changed as needed. For instance, referring to FIG. 4, each transfer bias generated by the power supply circuits VA, VB, VC, and VD may have an arbitrary waveform (e.g., a sinusoidal waveform and a triangle waveform) other than the rectangle waveform as exemplified in the aforementioned embodiment. Further, in the aforementioned embodiment, the four power supply circuits VA, VB, VC, and VD are provided to generate the respective transfer biases with a phase difference of 90 degrees between any adjacent two of the power supply circuits VA, VB, VC, and VD in the aforementioned order (four phases). However, three power supply circuits may be provided to generate respective transfer biases with a phase difference of 120 degrees between any two of the three power supply circuits (three phases).

The development bias may only contain a DC voltage component (including the voltage level of around). In this case, the other bias voltages may be changed as needed in response to the change of the development bias.

The retrieving bias, which is applied to the retrieving roller 66 by the retrieving bias power supply circuit 685, may have a phase synchronized with the phase of the development bias. Namely, a retrieving voltage, which is a voltage potential difference generated between the development roller 62 and the retrieving roller 66 based on the development bias and the retrieving bias, may contain only a DC voltage component. Alternatively, the retrieving bias may contain only a DC voltage component. When the DC voltage component is identical to the voltage level of ground (0 V), the retrieving bias power supply circuit 685 may be omitted with the retrieving roller 66 being electrically connected with a grounded member (e.g., a metal main body frame of the laser printer 1).

For example, instead of the retrieving roller 66, a brash roller may be employed.

For example, instead of the removal blade 67, a brash roller may be employed.

FIG. 6 is a cross-sectional side view schematically showing a configuration of a toner supply device 6 in a modification according to aspects of the present invention. As illustrated in FIG. 6, instead of the removal blade 67 shown in FIG. 2, a retrieving electric-field transfer board 63*c* may be employed, which is configured as a part of the electric-field transfer board 63.

The retrieving electric-field transfer board 63*c* may be formed in a shape of a flat plate and fixed to an inner wall surface of the toner box 61 so as to face the vertical electric-field transfer board 63*b*. An upper end of the retrieving electric-field transfer board 63*c*, which is a starting point in the toner transfer direction TTD, may be disposed to face the retrieving roller 66 in closest proximity to the retrieving roller 66. A lower end of the retrieving electric-field transfer board 63*c*, which is an end point in the toner transfer direction TTD, may be configured to extend down toward the toner storage section 61*a* from the starting point (the end point may reach the toner storage section 61*a* as shown in FIG. 6).

The retrieving electric-field transfer board 63*c* may be electrically connected with a retrieving transfer bias power supply circuit 686. The retrieving transfer bias power supply circuit 686 may be configured to apply, to a plurality of transfer electrodes 631 of thereof, a retrieving bias for retrieving the toner T from the retrieving roller 66 and transferring the retrieved toner T down toward the toner storage section 61*a*, in the position where the retrieving electric-field transfer board 63*c* faces the retrieving roller 66 in closest proximity to the retrieving roller 66.

In this case, the retrieving bias power supply circuit 686 may be configured to output a transfer bias (−800 to −200 V) containing a DC voltage component of −500 V and a multi-phase AC voltage component with an amplitude of 300 V and a frequency of 300 Hz. Further, there may be a gap of 0.5 mm provided in the toner retrieving position TRP between the development roller 62 (the toner holding surface 62*a*) and the retrieving electric-field transfer board 63*c*.

What is claimed is:

1. A developer supply device configured to supply charged development agent to an intended device, comprising:

a developer holding member that comprises a developer holding surface that is formed as a cylindrical circumferential surface parallel to a first direction and disposed to face the intended device in a first position, wherein the developer holding member is configured to rotate around an axis parallel to the first direction such that the developer holding surface moves in a second direction perpendicular to the first direction;

a developer transfer unit that comprises an electric-field transfer board comprising a plurality of transfer electrodes each of which is elongated in a longitudinal direction thereof parallel to the first direction, the transfer electrodes being arranged along a direction perpendicular to the first direction, wherein the electric-field transfer board is configured to generate a traveling-wave electric field when a transfer bias that is a multi-phase alternating-current voltage is applied to the transfer electrodes, and wherein the developer transfer unit is configured to, under the traveling-wave electric field generated by the electric-field transfer board, convey the development agent to the developer holding member and transfer the conveyed development agent onto the developer holding surface in a second position upstream relative to the first position in the second direction such that the developer holding surface holds and carries thereon the transferred development agent;

a developer retrieving member disposed to face the developer holding surface across a predetermined distance in a third position downstream relative to the first position in the second direction, wherein the developer retrieving member is driven to rotate around an axis parallel to the first direction, and wherein the developer retrieving member is configured to retrieve the development agent from the developer holding surface under a retrieving electric field that is generated when a retrieving voltage is applied between the developer retrieving member and the developer holding member; and a removal unit configured to remove, from the developer retrieving member, the development agent retrieved from the developer holding surface by the developer retrieving member, wherein the removal unit comprises a removal electric-field transfer board comprising a plurality of removal transfer electrodes each of which is elongated in a longitudinal direction thereof parallel to the first direction, the removal transfer electrodes being arranged along a direction perpendicular to the first direction, wherein the removal electric-field transfer board is configured to generate a removal electric field when a removal bias is applied to the removal transfer electrodes, wherein the removal unit is disposed to face a circumferential surface of the developer retrieving member across a predetermined distance in a position downstream relative to the third position in a direction in which the circumferential surface of the developer retrieving member moves when the developer retrieving member is driven to rotate, and wherein the removal unit is configured to remove the retrieved development agent from the developer retrieving member under the removal electric field generated by the removal electric-field transfer board.

2. The developer supply device according to claim 1, further comprising:

a development bias power supply that is electrically connected with the developer holding member and configured to apply a development bias to the developer holding member; and a retrieving bias power supply that is electrically connected with the developer retrieving member and configured to apply a retrieving bias to the developer retrieving member, wherein the retrieving voltage applied between the developer retrieving member and the developer holding member is a voltage potential difference between the retrieving bias applied to the developer retrieving member by the retrieving bias power supply and the development bias applied to the developer holding member by the development bias power supply.

3. The developer supply device according to claim 1, wherein the removal unit is disposed in a position downstream relative to the third position in a direction in which a circumferential surface of the developer retrieving member moves when the developer retrieving member is driven to rotate, and wherein the removal unit is configured to remove the retrieved development agent from the circumferential surface of the developer retrieving member while sliding in contact with the circumferential surface of the developer retrieving member.

4. An image forming apparatus comprising:

a photoconductive body configured such that a development agent image is formed thereon; and a developer supply device configured to supply charged development agent to the photoconductive body, wherein the developer supply device comprises:

a developer holding member that comprises a developer holding surface that is formed as a cylindrical circumferential surface parallel to a first direction and disposed to face the photoconductive body in a first position, wherein the developer holding member is configured to rotate around an axis parallel to the first direction such that the developer holding surface moves in a second direction perpendicular to the first direction;

a developer transfer unit that comprises an electric-field transfer board comprising a plurality of transfer electrodes each of which is elongated in a longitudinal direction thereof parallel to the first direction, the transfer electrodes being arranged along a direction perpendicular to the first direction, wherein the electric-field transfer board is configured to generate a traveling-wave electric field when a transfer bias that is a multi-phase alternating-current voltage is applied to the transfer electrodes, and wherein the developer transfer unit is configured to, under the traveling-wave electric field generated by the electric-field transfer board, convey the development agent to the developer holding member and transfer the conveyed development agent onto the developer holding surface in a second position upstream relative to the first position in the second direction such that the developer holding surface holds and carries thereon the transferred development agent;

a developer retrieving member disposed to face the developer holding surface across a predetermined distance in a third position downstream relative to the first position in the second direction, wherein the developer retrieving member is driven to rotate around an axis parallel to the first direction, and wherein the developer retrieving member is configured to retrieve the development agent from the developer holding surface under a retrieving electric field that is generated when a retrieving voltage is applied between the developer retrieving member and the developer holding member; and a removal unit configured to remove, from the developer retrieving member, the development agent retrieved from the developer holding surface by the developer retrieving member, wherein the removal unit comprises a removal electric-field transfer board comprising a plurality of removal transfer electrodes each of which is elongated in a longitudinal direction thereof parallel to the first direction, the removal transfer electrodes being arranged along a direction perpendicular to the first direction, wherein the removal electric-field transfer board is configured to generate a removal electric field when a removal bias is applied to the removal transfer electrodes, wherein the removal unit is disposed to face a circumferential surface of the developer retrieving member across a predetermined distance in a position downstream relative to the third position in a direction in which the circumferential surface of the developer retrieving member moves when the developer retrieving member is driven to rotate, and wherein the removal unit is configured to remove the retrieved development agent from the developer retrieving member under the removal electric field generated by the removal electric-field transfer board.

5. The image forming apparatus according to claim 4, wherein the developer supply device further comprises:

a development bias power supply that is electrically connected with the developer holding member and configured to apply a development bias to the developer holding member; and a retrieving bias power supply that is electrically connected with the developer retrieving member and configured to apply a retrieving bias to the developer retrieving member, and wherein the retrieving voltage applied between the developer retrieving member and the developer holding member is a voltage potential difference between the retrieving bias applied to the developer retrieving member by the retrieving bias power supply and the development bias applied to the developer holding member by the development bias power supply.

6. The image forming apparatus according to claim 4, wherein the removal unit is disposed in a position downstream relative to the third position in a direction in which a circumferential surface of the developer retrieving member moves when the developer retrieving member is driven to rotate, and wherein the removal unit is configured to remove the retrieved development agent from the circumferential surface of the developer retrieving member while sliding in contact with the circumferential surface of the developer retrieving member.

* * * * *